US006210195B1

(12) United States Patent
Ma

(10) Patent No.: US 6,210,195 B1
(45) Date of Patent: Apr. 3, 2001

(54) CARD EDGE CONNECTOR WITH CARD RETAINING MEANS

(75) Inventor: Hao-Yun Ma, Tu-Chen (TW)

(73) Assignee: Hon Hai Precision Inc. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/452,289

(22) Filed: Nov. 30, 1999

(51) Int. Cl.[7] ..... H01R 13/62
(52) U.S. Cl. ..... 439/327
(58) Field of Search ..... 439/327, 347

(56) References Cited

U.S. PATENT DOCUMENTS 5,650,917 * 7/1997 Hsu ..... 439/327
6,027,358 * 2/2000 Lai et al. ..... 439/327

* cited by examiner

*Primary Examiner*—Gary F. Paumen
(74) *Attorney, Agent, or Firm*—Wei Te Chung

(57) ABSTRACT

A card edge connector comprises an insulative housing defining an elongate slot for receiving a daughter board therein, an engaging arm extending from a longitudinal end of the housing with a receiving hole defined therein, a locking member for locking into the receiving hole of the arm, and a number of contacts received in passageways defined in the housing for connecting with conductive pads of the inserted daughter board. The locking member extends through a notch defined in a longitudinal edge of the inserted daughter board and the receiving hole of the engaging arm. The locking member is locked into the receiving hole of the arm and abuts against a lower edge of the notch of the daughter board to prevent an upward movement thereof thereby retaining the inserted daughter board in position.

6 Claims, 9 Drawing Sheets

CARD EDGE CONNECTOR WITH CARD RETAINING MEANS

BACKGROUND OF THE INVENTION

1. Field of the Invention

The present invention relates to a card edge connector, and particularly to a card edge connector having retaining means for retaining an inserted daughter board in position.

2. Description of Prior Art

To meet the ever-increasing requirements of expanding computer memory, a card edge connector is commonly used to interconnect an inserted daughter board with a mother board on which the connector is mounted. In the prior art, an auxiliary retainer is commonly provided for retaining the daughter board in the card edge connector thereby insuring a reliable connection therebetween.

A currently used conventional retainer typically comprises a U-shaped body for receiving a card edge connector, and a pair of vertical recessed arms for retaining edges of an inserted daughter board. Such a retainer is mounted to a mother board, using means such as bolts and nuts. Pertinent devices are disclosed in Taiwan Patent Application Nos. 86215468 and 86219634. The assembly process of such a design is tedious and time-consuming. In addition, an auxiliary tool must be used during assembly and disassembly of the retainer, which is inconvenient. Furthermore, such a design compromises the integrity of the mother board due to the provision of holes therein for extension of the bolts and nuts. Too many components are also required thereby complicating shipping and handling.

Taiwan Patent Application No. 82205007 discloses another conventional retainer. As shown in FIG. 8, the retainer consists of a clasping member 40 and a separate vertical member 44 for respectively preventing upward and lateral movements of a daughter board 46 inserted into a card edge connector 47. The clasping member 40 comprises opposite first and second clasping ends 41 and 42, and a resilient portion 43 formed between the clasping ends 41 and 42. The first clasping end 41 has an engaging hook 410 attached to the bottom of the connector 47 by double-face adhesive tape. The second clasping end 42 has a clasp 420 for clasping an upper edge of the daughter board 46. The vertical member 44 is provided on an inner surface of a computer enclosure 45 and comprises two parallel strips for sandwiching a longitudinal edge of the daughter board 46. This arrangement requires two components, i.e., the clasping member 40 and the vertical member 44, to retain the daughter board 46 in position, thereby complicating manufacturing and increasing material waste, which results in high costs. In addition, it is difficult to attach the vertical member 44 to the inner surface of the computer enclosure 45.

The present invention is directed at solving the aforesaid problems by providing a card edge connector which can retain an inserted daughter board in position without the need of an auxiliary retainer thereby reducing manufacturing costs and the number of components.

SUMMARY OF THE INVENTION

Accordingly, one object of the present invention is to provide a card edge connector having retaining means formed thereon for retaining an inserted daughter board in position thereby eliminating the need of an auxiliary retainer.

Another object of the present invention is to provide a card edge connector with reduced number of components thereby facilitating manufacturing and reducing costs.

In order to achieve the objects set forth, a card edge connector in accordance with the present invention comprises an insulative housing defining an elongate slot for receiving a daughter board therein, an engaging arm formed on a longitudinal end of the housing with a receiving hole defined therethrough, a locking member for locking into the receiving hole of the arm, and a plurality of contacts received in passageways defined in the housing.

The receiving hole of the engaging arm may be a through hole or a polygonal hole. The locking member may have various forms, such as a locking pin, a resilient pin, a planar pin, or a combination of a resilient pin and an engaging post. In assembly, the locking member sequentially extends through a notch defined in a longitudinal edge of the daughter board and the receiving hole of the engaging arm. The locking member locks into the receiving hole and abuts against a lower edge of the notch of the daughter board to prevent the inserted daughter board from moving upward. The engaging arm abuts against a side surface of the daughter board and the locking member abuts against an opposite side surface of the daughter board thereby preventing a lateral movement of the inserted daughter board relative to the connector. Thus, the daughter board is securely retained in the connector.

Other objects, advantages and novel features of the invention will become more apparent from the following detailed description when taken in conjunction with the accompanying drawings.

DETAILED DESCRIPTION OF THE PREFERRED EMBODIMENTS

Figure 1:
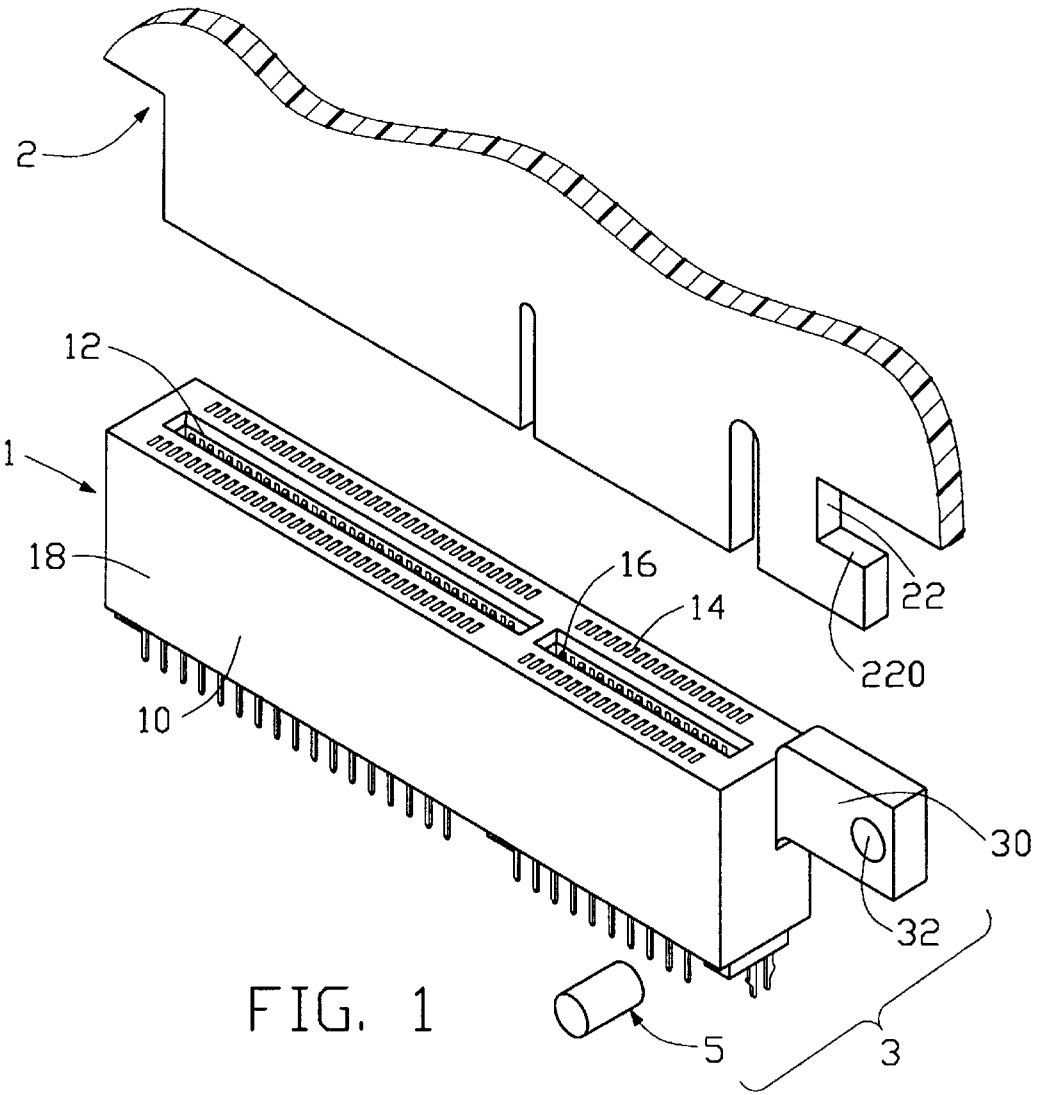
FIG. 1 is an exploded view of a card edge connector having an engaging arm with a through hole defined therein, and a locking member in the form of a pin to be inserted into the through hole in accordance with the present invention, and a daughter board to be inserted into the connector.

Reference will now be made to the drawing figures to describe the present invention in detail.

Referring to FIG. 1, a card edge connector 1 in accordance with the present invention comprises an insulative housing 10 having a pair of opposite side walls 18, an elongate slot 12 defined between the opposite side walls 18 for receiving a daughter board 2 therein, and a plurality of contacts 16 received in corresponding passageways 14 defined in the side walls 18. The contacts 16 are adapted for engaging with corresponding conductive pads (not shown) proximate the bottom of the inserted daughter board 2 to establish an electrical connection between the daughter board 2 and a mother board (not shown) on which the connector 1 is mounted.

Figure 2:
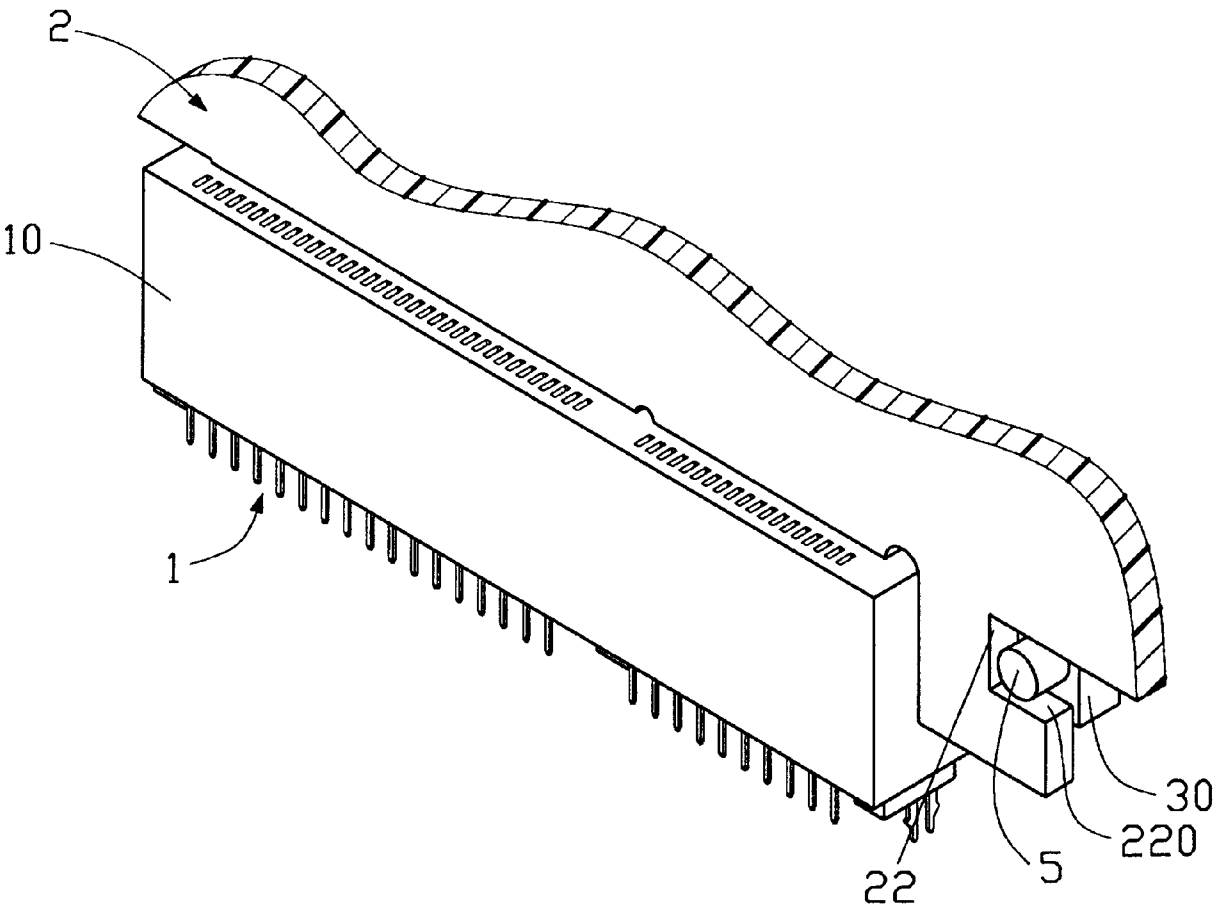
FIG. 2 is an assembled view of FIG. 1.

The connector 1 further comprises card retaining means 3 for retaining the inserted daughter board 2 in position. The retaining means 3 includes an engaging arm 30 outwardly extending from a longitudinal end of the housing 10 with a through hole 32 defined therein, and a locking member in the form of a cylindrical pin 5. A notch 22 is defined in a longitudinal edge of the daughter board 2 proximate the bottom thereof. The pin 5 sequentially extends through the notch 22 of the inserted daughter board 2 and the through hole 32 of the connector 1. The pin 5 locks into the through hole 32 of the engaging arm 30 and abuts against a lower edge 220 of the notch 22 of the daughter board 2 thereby preventing the inserted daughter board 2 from moving upward, as shown in FIG. 2.

The locking member of the retaining means 3 may have various forms to cooperate with the through hole 32 of the engaging arm 30 for retaining the inserted daughter board 2 in position, as illustrated in FIGS. 3 to 5B.

Figure 3:
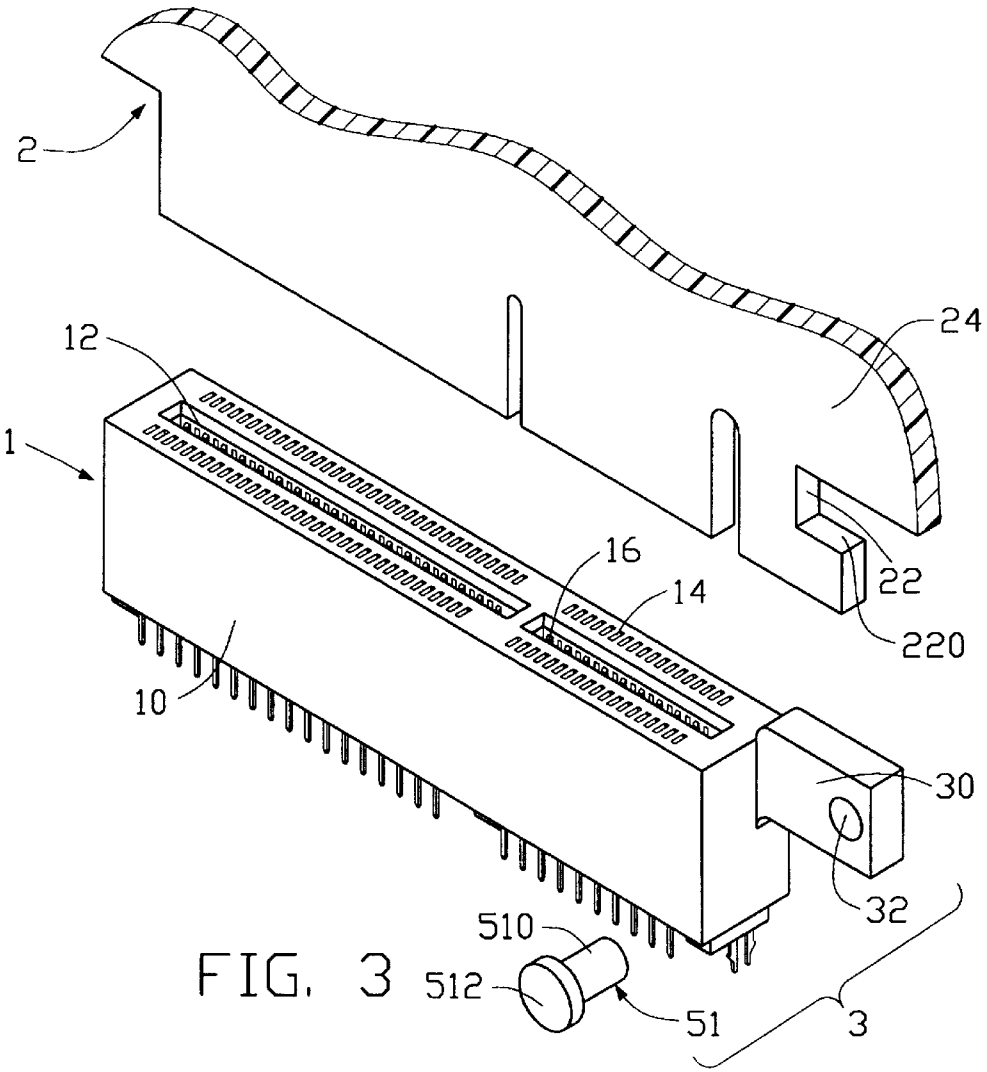
FIG. 3 is a view similar to FIG. 1 but incorporating a locking member in the form of a locking pin.

The locking member as illustrated in FIG. 3 is in the form of a locking pin 51. The locking pin 51 comprises a body 510 for sequentially extending through the notch 22 of the inserted daughter board 2 and the through hole 32 of the connector 1, and a stop 512 having a larger diameter than the body 510. The body 510 abuts against the lower edge 220 of the notch 22 of the daughter board 2 to prevent an upward movement of the daughter board 2. The stop 512 of the locking pin 51 and the engaging arm 30 respectively abut against a side surface 24 and an opposite side surface of the daughter board 2 to prevent a lateral movement of the daughter board 2. Thus, the inserted daughter board 2 is retained in position.

Figure 4:
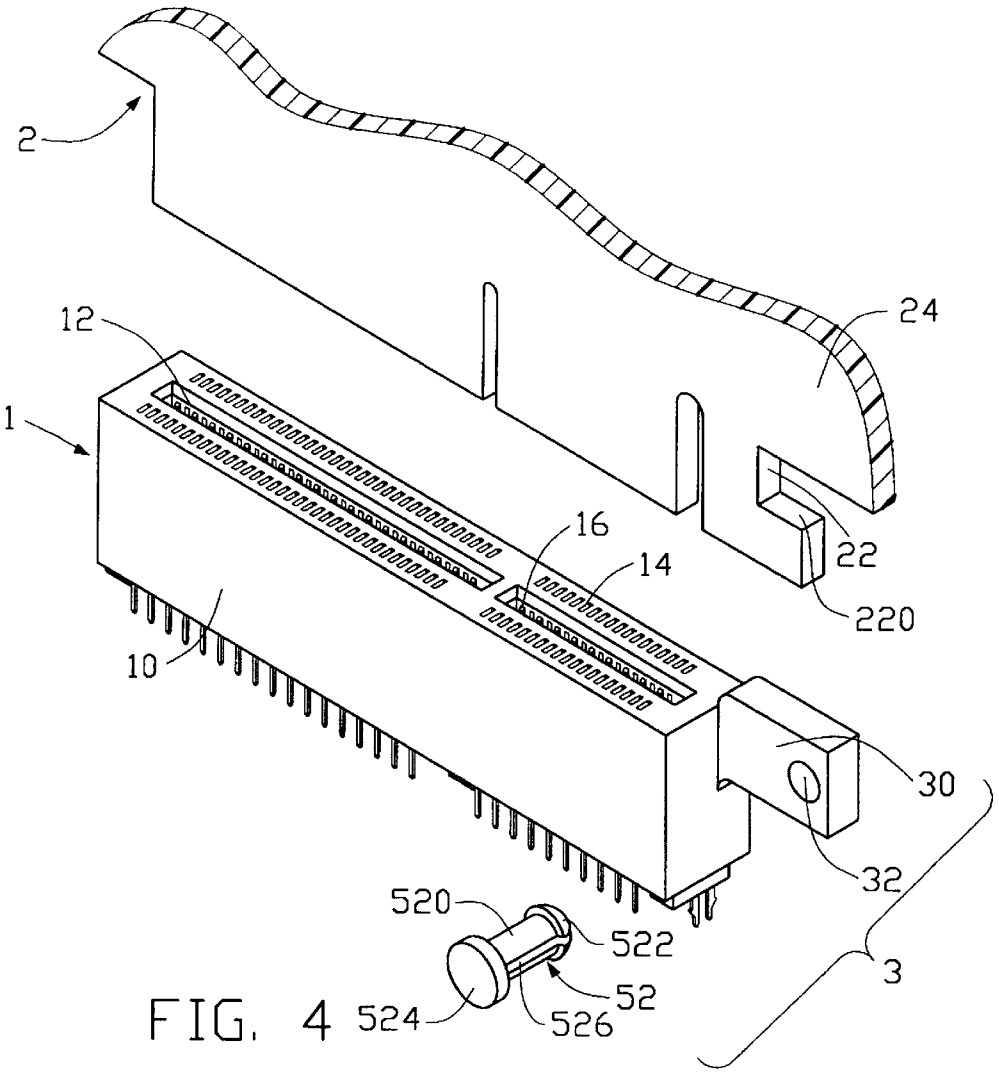
FIG. 4 is a view similar to FIG. 1 but incorporating a locking member in the form of a resilient pin.

FIG. 4 illustrates a locking member in the form of a resilient pin 52. The resilient pin 52 comprises a head 522 and a stop 524 formed on opposite ends thereof, and a body 520 between the head 522 and the stop 524. A groove 526 is defined in the body 520 and the head 522 for providing resiliency thereof. The head 522 tapers toward a free end thereof having the largest diameter proximate the body 520 and larger than the body 520, and the stop 524 has a diameter larger than both of the body 520 and the head 522. The body 520 has a diameter slightly larger than the through hole 32 of the engaging arm 30. In assembly, the head 522 and the body 520 sequentially extend through the notch 22 of the daughter board 2 and the through hole 32 of the connector 1. The head 522 is compressed and then resiliently resumes its original shape to bias against the engaging arm 30. The body 520 is resiliently received in the through hole 32 and abuts against the lower edge 220 of the notch 22 of the daughter board 2. The stop 524 of the resilient pin 52 and the engaging arm 30 respectively abut against the side surface 24 and the opposite side surface of the daughter board 2 to prevent a lateral movement of the daughter board 2. Thus, the inserted daughter board 2 is retained in position.

Figure 5A:
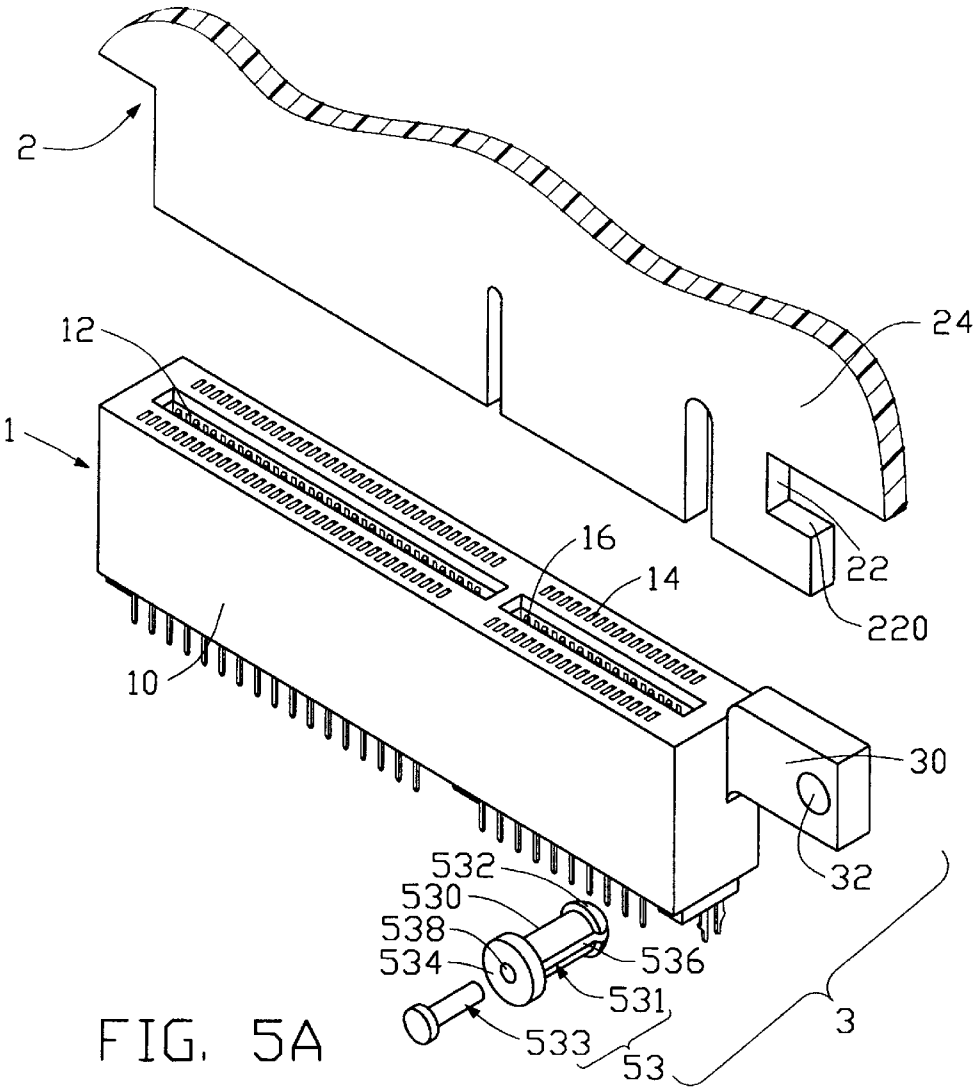
FIG. 5A is a view similar to FIG. 1 but incorporating a locking member in the form of a resilient pin and an engaging post to be inserted into the resilient pin in a first direction.

The locking member 53 illustrated in FIG. 5A includes a resilient pin 531 and an engaging post 533. The resilient pin 531 is similar to the resilient pin 52 in FIG. 4 except that a passage 538 is defined therethrough in communication with a groove 536 defined in a body 530 and a head 532 thereof. In assembly, the head 532 and the body 530 of the resilient pin 531 sequentially extend through the notch 22 of the daughter board 2 and the through hole 32 of the connector 1. The engaging post 533 then extends through the passage 538 of the resilient pin 531 in the same direction as the resilient pin 531 thereby securely locking the resilient pin 531 into the through hole 32 to retain the inserted daughter board 2 in position.

Figure 5B:
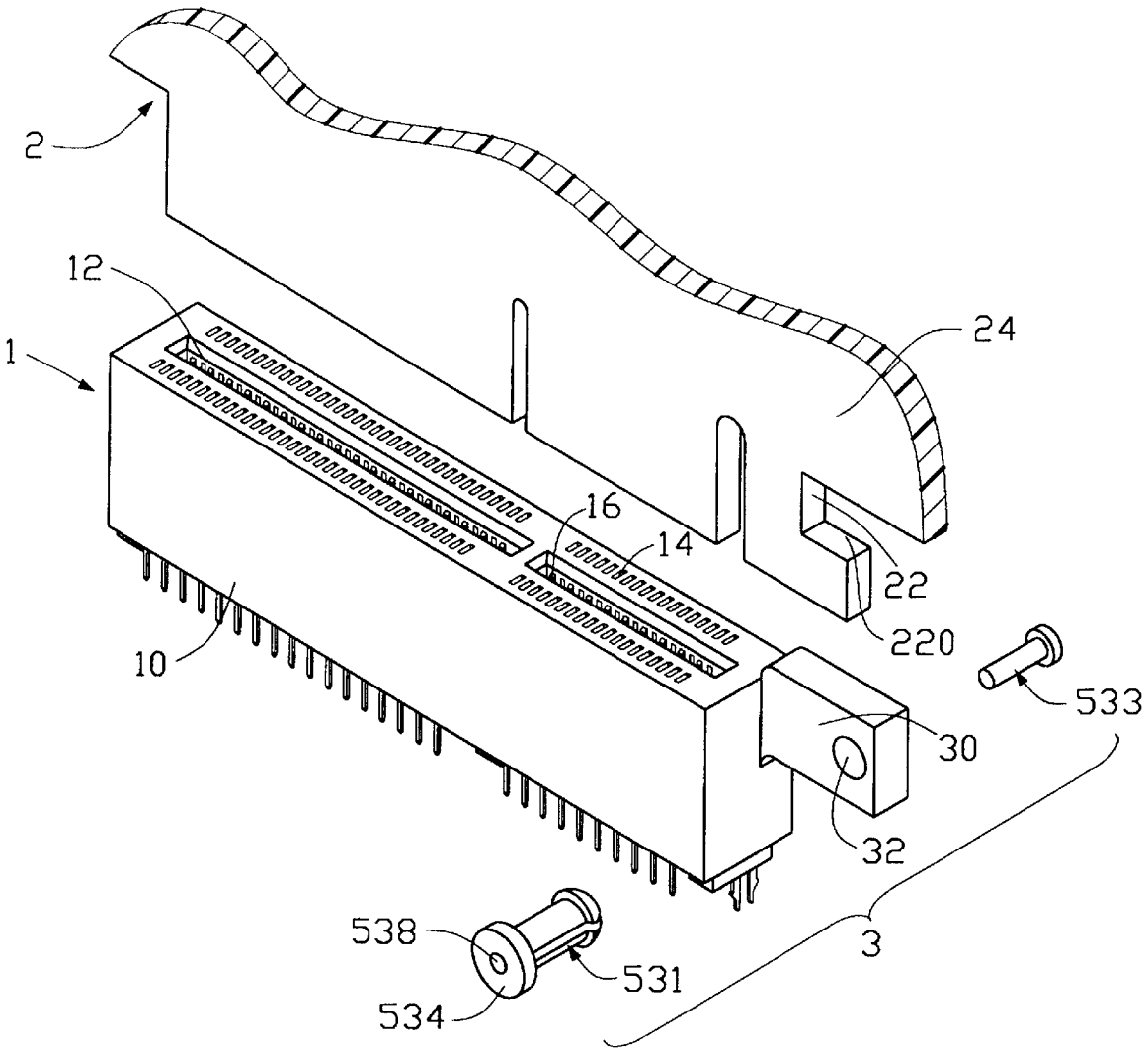
FIG. 5B is a view similar to FIG. 5A but with the engaging post to be inserted into the resilient pin in an opposite direction.

FIG. 5B illustrates that the engaging post 533 can also be inserted into the passage 538 of the resilient pin 531 in a reversed direction relative to the insertion direction of the resilient pin 531.

Figure 6:
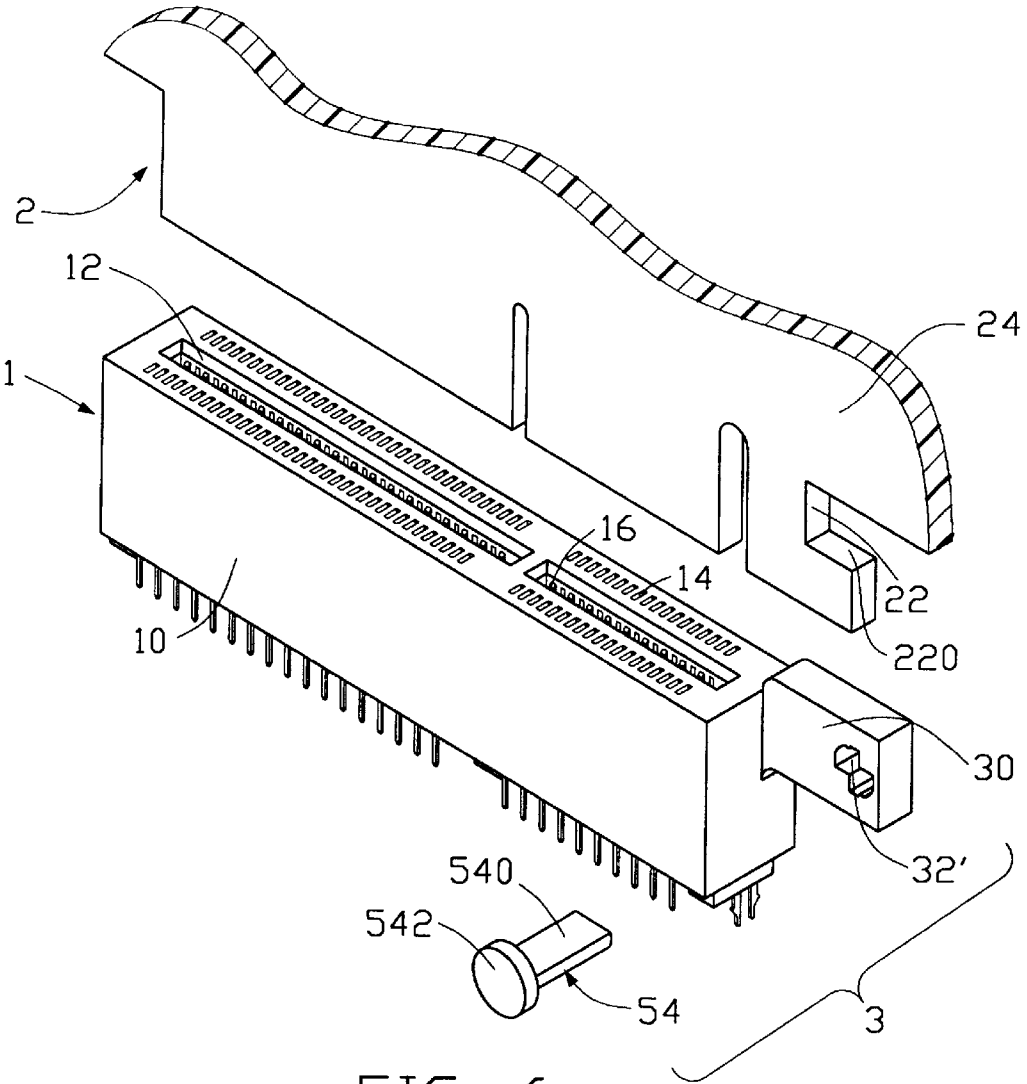
FIG. 6 is an exploded view of a card edge connector having an engaging arm with a polygonal hole defined therein, and a locking member in the form of a planar pin to be rotatably locked into the polygonal hole in accordance with another embodiment of the present invention, and a daughter board to be inserted into the connector.
Figure 7B:
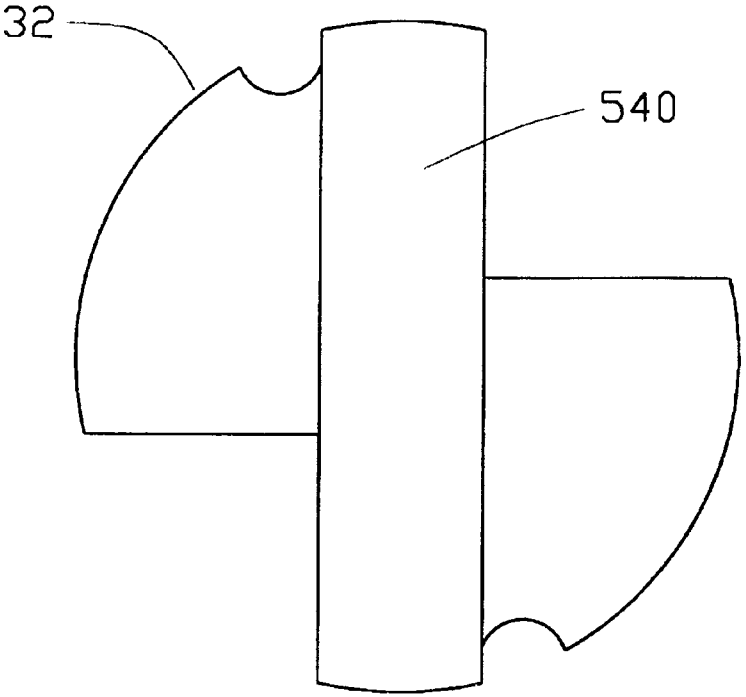
FIGS. 7A and 7B are schematic views illustrating sequential engagements between the polygonal hole and the planar pin of FIG. 6.
Figure 7A:
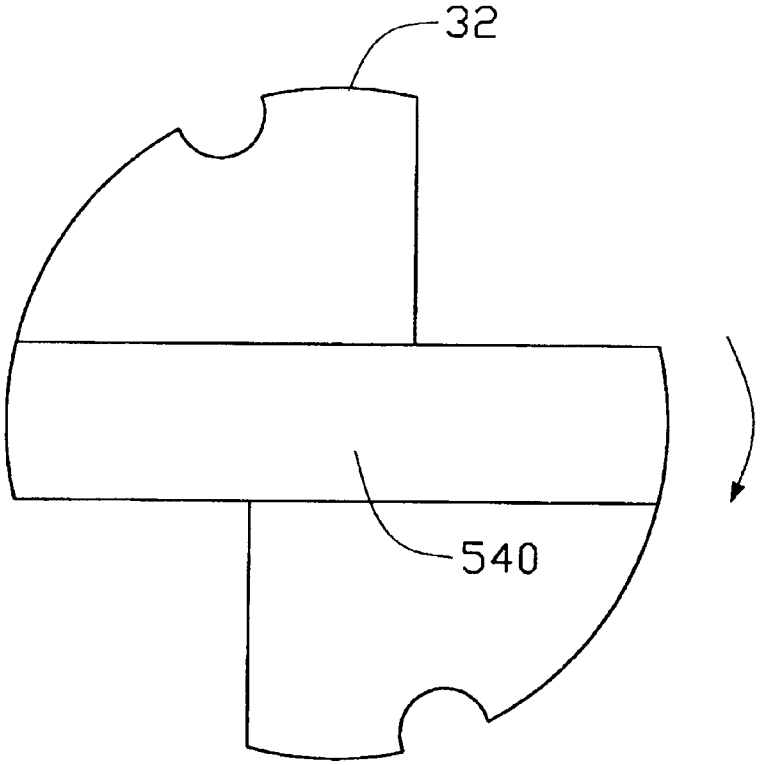
Figure 8:
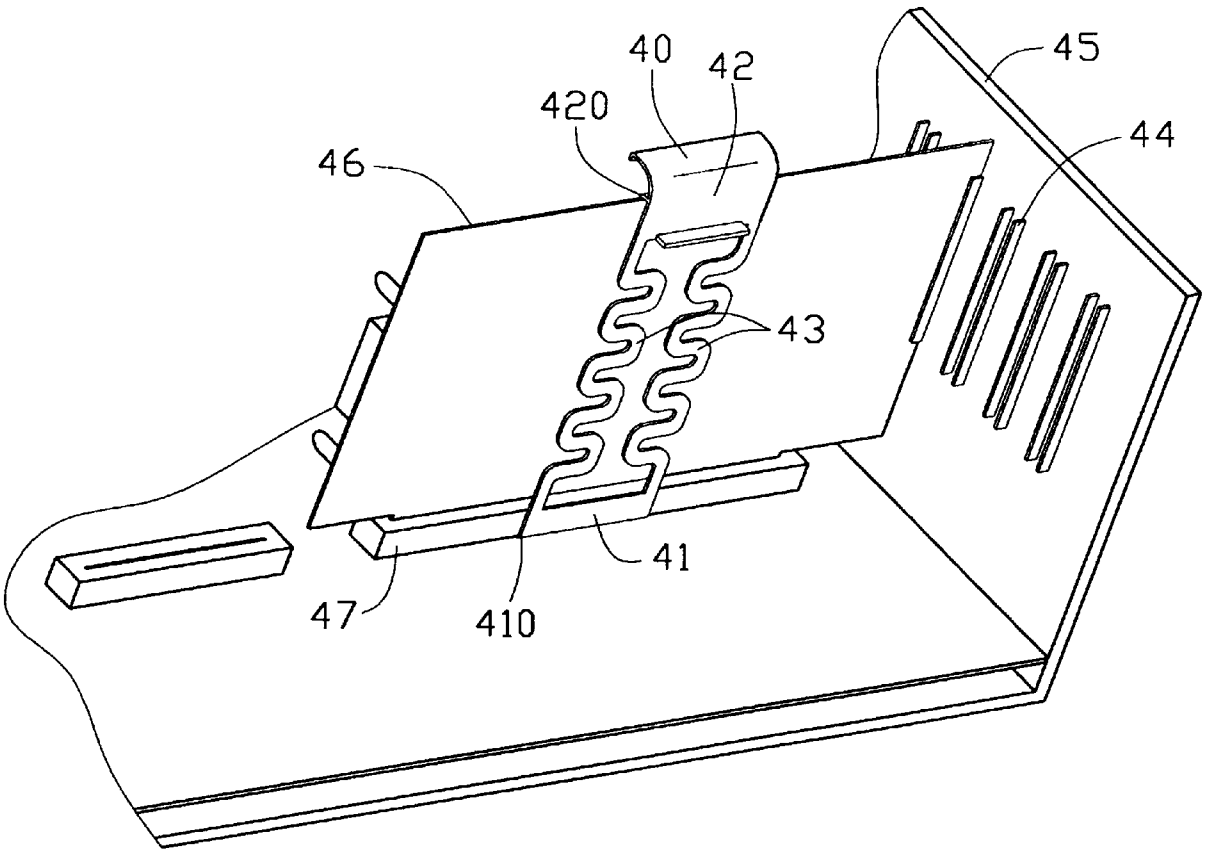
FIG. 8 (PRIOR ART)
FIG. 8 is a perspective view of a conventional card edge connector retaining an inserted daughter board by a clasping member and a vertical member.

FIG. 6 shows a card edge connector 1 in accordance with another embodiment of the present invention. A polygonal hole 32' is defined in the engaging arm 30. The locking member is in the form of a planar pin 54 comprising a planar portion 540 for rotatably engaging with the polygonal hole 32' and a stop 542 for abutting against the daughter board 2. The planar portion 540 sequentially extends through the notch 22 of the daughter board 2 and the polygonal hole 32' of the connector 1 in an initial position whereby the planar portion 540 is horizontally retained in the polygonal hole 32' as illustrated in FIG. 7A. The planar pin 54 is then rotated clockwise to move the planar portion 540 thereof to a final position whereby the planar portion 540 is vertically retained in the polygonal hole 32' as illustrated in FIG. 7B. In the final position, the planar portion 540 abuts against the lower edge 220 of the notch 22 of the daughter board 2. The stop 542 of the planar pin 54 and the engaging arm 30 respectively abut against the side surface 24 and the opposite side surface of the daughter board 2 to prevent a lateral movement of the daughter board 2. Thus, the inserted daughter board 2 is securely retained in position.

Due to the provision of the engaging arm 30 of the connector 1, and a locking member 5, 51, 52, 53 and 54, upward and lateral movements of the inserted daughter board 2 are prevented thereby retaining the daughter board 2 in position. Thus, the need of an auxiliary retainer is eliminated, thereby simplifying manufacturing, reducing manufacturing costs and facilitating assembly.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A card edge connector for interconnecting an inserted daughter board with a mother board on which the connector is mounted, the daughter board defining a notch in a longitudinal edge adjacent to a bottom edge thereof, the card edge connector comprising:

an insulative housing comprising a pair of opposite side walls, an elongate slot defined between the side walls for receiving the daughter board, a plurality of passageways defined in the side walls, and an engaging arm outwardly extending from a longitudinal end thereof;

a plurality of contacts received in corresponding passageways of the housing; and a locking member extending through the notch of the inserted daughter board and engaging with the engaging arm, the locking member abutting against a lower edge of the notch of the daughter board to prevent an upward movement of the daughter board thereby retaining the daughter board in position;

wherein the engaging arm defines a receiving hole for extension of the locking member therethrough, the notch and the receiving hole being collinear.

2. The card edge connector as described in claim 1, wherein the locking member comprises a cylindrical pin.

3. The card edge connector as described in claim 1, wherein the locking member comprises a locking pin, the locking pin including a body for abutting against the lower edge of the notch of the daughter board and for locking in the receiving hole of the arm, and a stop having a larger diameter than the body for abutting against a side surface of the daughter board.

4. The card edge connector as described in claim 1, wherein the locking member comprises a resilient pin, the resilient pin including a head and a stop formed on opposite ends thereof, and a body between the head and the stop, the body and the head defining a groove therein for providing resiliency, the head tapering toward a free end thereof for extending through and biasing against the engaging arm, the body having a diameter slightly larger than that of the receiving hole of the engaging arm for being resiliently received therein and abutting against the lower edge of the notch of the daughter board, the stop having a diameter larger than the body for abutting against a side surface of the daughter board.

5. The card edge connector as described in claim 1, wherein the locking member comprises a resilient pin and an engaging post for being inserted in and expanding the resilient pin, the resilient pin including a body, a head formed on one end of the body, a stop formed on another end of the body, a groove defined in the body and the head for providing resiliency, and a through hole defined in the stop, the body and the head in communication with the groove for the extension of the engaging post, the head tapering toward a free end thereof for extending through and biasing against the engaging arm, the body being expanded by the inserted engaging post thereby being resiliently received in the receiving hole of the engaging arm and abutting against the lower edge of the notch of the daughter board, the stop having a diameter larger than the body for abutting against a side surface of the daughter board.

6. The card edge connector as described in claim 1, wherein the receiving hole of the engaging arm is a polygonal hole, and the locking member comprises a planar pin, the planar pin including a planar portion and a stop for abutting against a side surface of the inserted daughter board, the planar portion being rotatably received in the polygonal hole from an initial insertion position where the planar portion is horizontally retained in the polygonal hole to a final locking position where the planar portion is vertically locked in the polygonal hole and abuts against the lower edge of the notch of the inserted daughter board.

* * * * *